US009076300B2

(12) United States Patent
Sarzotti et al.

(10) Patent No.: US 9,076,300 B2
(45) Date of Patent: Jul. 7, 2015

(54) CARD GAME WITH AUCTION FUNCTION

(71) Applicants: Bruno Sarzotti, Turin (IT); Claudio Tibaldi, Turin (IT); Santo Antonio Micciché, Turin (IT)

(72) Inventors: Bruno Sarzotti, Turin (IT); Claudio Tibaldi, Turin (IT); Santo Antonio Micciché, Turin (IT)

( * ) Notice: Subject to any disclaimer, the term of this patent is extended or adjusted under 35 U.S.C. 154(b) by 0 days.

(21) Appl. No.: 14/178,934

(22) Filed: Feb. 12, 2014

(65) Prior Publication Data

US 2014/0162766 A1 Jun. 12, 2014

Related U.S. Application Data

(63) Continuation-in-part of application No. 12/794,107, filed on Jun. 4, 2010, now abandoned.

(60) Provisional application No. 61/184,087, filed on Jun. 4, 2009.

(51) Int. Cl.

| | |
|---|---|
| ***A63F 1/00*** | (2006.01) |
| ***G07F 17/32*** | (2006.01) |
| *A63F 3/00* | (2006.01) |

(52) U.S. Cl.

CPC ... *G07F 17/3258* (2013.01); *A63F 2003/00167* (2013.01); *A63F 1/00* (2013.01); *A63F 3/00157* (2013.01)

(58) Field of Classification Search

USPC ..... 273/292

See application file for complete search history.

(56) References Cited

U.S. PATENT DOCUMENTS

| | | | | |
|---|---|---|---|---|
| 4,437,670 | A | 3/1984 | Simon | |
| 7,418,422 | B2 * | 8/2008 | Burns | 705/37 |
| 7,520,509 | B1 | 4/2009 | Haber | |
| 7,527,267 | B2 | 5/2009 | Webb et al. | |
| 7,533,886 | B2 | 5/2009 | Kenny et al. | |
| 7,945,463 | B2 * | 5/2011 | Sussman et al. | 705/5 |
| 2002/0153663 | A1 * | 10/2002 | Hodge | 273/292 |
| 2005/0124402 | A1 | 6/2005 | Miller | |
| 2007/0265053 | A1 | 11/2007 | Linard et al. | |
| 2007/0287519 | A1 | 12/2007 | McLain | |
| 2008/0090632 | A1 | 4/2008 | Kumar | |
| 2008/0108401 | A1 | 5/2008 | Baerlocher et al. | |

(Continued)

OTHER PUBLICATIONS

Copyright Certificate of Registration, "Pokerasta" Jun. 12, 2007, United States Copyright Office, The Library of Congress.

(Continued)

*Primary Examiner* — Melba Bumgarner
*Assistant Examiner* — Amir Klayman
(74) *Attorney, Agent, or Firm* — Katten Muchin Rosenman LLP

(57) ABSTRACT

A method of playing a card game by a number of players competing for a jackpot contributed by the players that includes performing an auction phase by a computer. The auction phase can be applied to any kind of poker and includes the steps of revealing a face value of an auction card; auctioning the auction card; and (i) eliminating the auction card when none of the players makes a bid for the auction card, (ii) awarding the auction card to a player who makes a sole bid and requiring the player to pay the amount of the sole bid into the jackpot, or (iii) awarding the auction card to a player who makes a winning bid among a plurality of bids and requiring the player to pay the amount of the winning bid to the player having the second best bid. The step of auctioning the auction card includes a bidding period that is timed by a computer (connected with the input terminal of the manager when the manager is not a computer). Each user utilizes a keypad and/or touch screen display to input and increase bids.

17 Claims, 9 Drawing Sheets

(56) References Cited

U.S. PATENT DOCUMENTS

| | | | |
|---|---|---|---|
| 2008/0146344 | A1 | 6/2008 | Rowe et al. |
| 2008/0315525 | A1 | 12/2008 | Hoyt et al. |
| 2009/0291762 | A1 | 11/2009 | Walker |

OTHER PUBLICATIONS

Pokerasta: Rules of the Game.

United States Office Action dated Sep. 19, 2012, from corresponding U.S. Appl. No. 12/794,107.

United States Office Action dated Mar. 26, 2013, from corresponding U.S. Appl. No. 12/794,107.

United States Advisory Action dated Jul. 11, 2013, from corresponding U.S. Appl. No. 12/794,107.

United States Office Action dated Aug. 14, 2013, from corresponding U.S. Appl. No. 12/794,107.

* cited by examiner

200

| | |
|---|---|
| Players | 4 |
| Ante | 100 US dollars |
| Bidding period auction phase | 4 seconds |
| Keep or eliminate? | 15 seconds |
| Bidding period final phase | 15 seconds |
| Wallet for auction phase | jackpot |
| Maximum total bet final phase | 1.5 x jackpot |

Fig. 3A

32b (Cards dealt, face down, and cards won)
Winning
Last
Wallet
130
100
180
206
20
100
10
50
208
(Cards dealt, face up, and cards won)
15
206
Winning
Last
Wallet
130
130
400
Auctioned Card
(Common cards)
Winning
Last
Wallet
130
120
280
206
(Cards dealt, face down, and cards won)
Keep
Eliminate
(Cards dealt, face down, and cards won)
Winning
Last
Wallet
130
110
360
206
7
8
9
4
5
6
1
2
3
0
Enter

CARD GAME WITH AUCTION FUNCTION

CROSS REFERENCE TO RELATED APPLICATIONS

This application is continuation-in part of and claims priority to U.S. Ser. No. 12/794,107, filed Jun. 4, 2010, which is pending and which is hereby incorporated by reference in its entirety for all purposes.

U.S. Ser. No. 12/794,107 is a non-provisional counterpart to and claims priority to U.S. Ser. No. 61/184,087 filed on Jun. 4, 2009, which is hereby incorporated by reference in its entirety for all purposes.

BACKGROUND OF THE INVENTION

1. Field of the Invention

The invention relates to card games and to methods of playing card games. In particular, the invention relates card games having a poker card game emulation.

2. Discussion of the Background of the Invention

Poker is a group of card games played where a plurality of players attempts to win an amount of money or chips, i.e., the jackpot, contributed by the players themselves. The specific rules of poker vary by custom and geography.

In general, poker is divided into a series of hands, which begin when a predefined number of cards, typically, western playing cards, are randomly dealt to each player so that the other players are unable to see the value of the cards, i.e., face down.

After the initial deal, each player must make a bet in a predetermined sequence, usually clockwise around the table. The first bettor can bet a predetermined minimum amount or raise and bet more than the predetermined minimum. Each subsequent bettor must match maximum previous bet or fold and lose all interest in the hand. The betting round ends when all players have either matched the last bet or folded. If all but one player folds on any round, the remaining player collects the jackpot without showing his hand. If more than one player remains in contention after the final betting round, the hands are shown and the winning hand takes the jackpot.

A hand may end at the showdown, in which case the remaining players compare their hands and the highest hand is awarded the jackpot; that highest hand is usually held by only one player, but can be held by more in the case of a tie. The other possibility for the conclusion of a hand is when all but one player have folded and have thereby abandoned any claim to the jackpot, in which case the jackpot is awarded to the player who has not folded.

However, traditional poker games fail to provide excitement and interest to certain players. Thus, a more interesting game and method of playing the game is desired.

SUMMARY OF THE INVENTION

These and other needs are met in accordance with one embodiment of the present invention by a method of playing a card game by a number of players competing for a jackpot contributed by the players that includes performing an auction phase. The auction phase includes the steps of revealing a face value of an auction card; auctioning the auction card; and (i) eliminating the auction card when none of the players makes a bid for the auction card, (ii) awarding the auction card to a player who makes a sole bid and requiring the player to pay the amount of the sole bid into the jackpot, or (iii) awarding the auction card to a player who makes a winning bid among a plurality of bids and requiring the player to pay the amount of the winning bid to a player having the second-best bid. The step of auctioning the auction card includes a bidding period that is timed. The auction phase can be applied to any kind of poker (5-draw, Texas Hold'em, Omaha etc.).

Therein the present invention is a method of playing an innovative game of chance that combines the game of poker (and its variations) with a computer which performs the auction phase, i.e. which acts as a timing device and allows players to purchase cards by means of a special Auction where the bids do not normally increase the jackpot, but rather increase the money (or score) of another player in proportion to the amount of the bids.

The aim of the game is to accumulate the most money (real or virtual) or points possible; this may happen by winning the jackpot (thanks to the individual cards purchased in the auction phase) or through the ability to participate at the right moment in the auction in order to be the second-best bidder and thereby receiving from the best bidder the amount of the winning bid (the best tactic is a combination of both these strategies).

BRIEF DESCRIPTION OF THE DRAWINGS

These and other features will become more readily apparent from the detailed description taken in conjunction with the following drawings:

FIG. 3A is a sample chart of the selections made by a manager during pre-play phase 100.

DETAILED DESCRIPTION OF THE INVENTION

Figure 2:
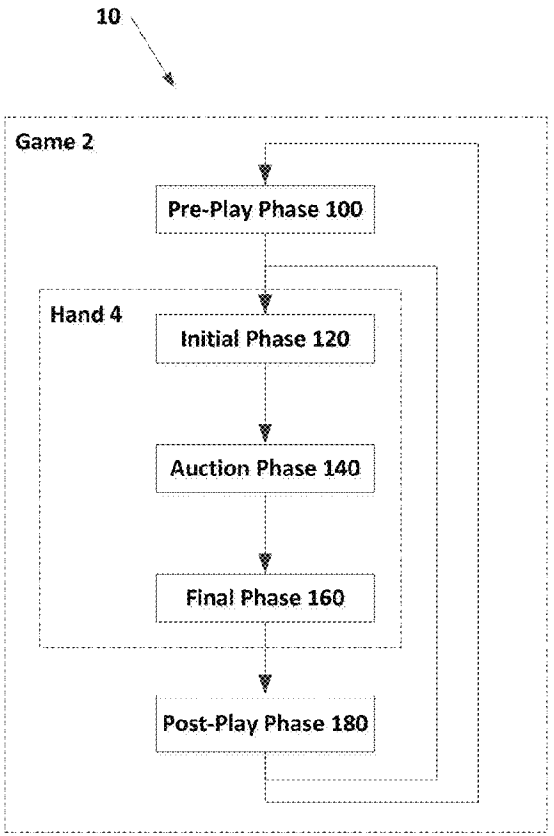
FIG. 2 is a flowchart of the method of playing a card game of FIG. 2.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale.

In accordance with one or more embodiments of the present invention, a method of playing a card game comprises certain steps of playing poker with a timed auction wherein players purchase cards by means of a timed auction where the bids do not increase the jackpot, but rather increase the money or score of another player in proportion to the amount of the bids.

Figure 1:
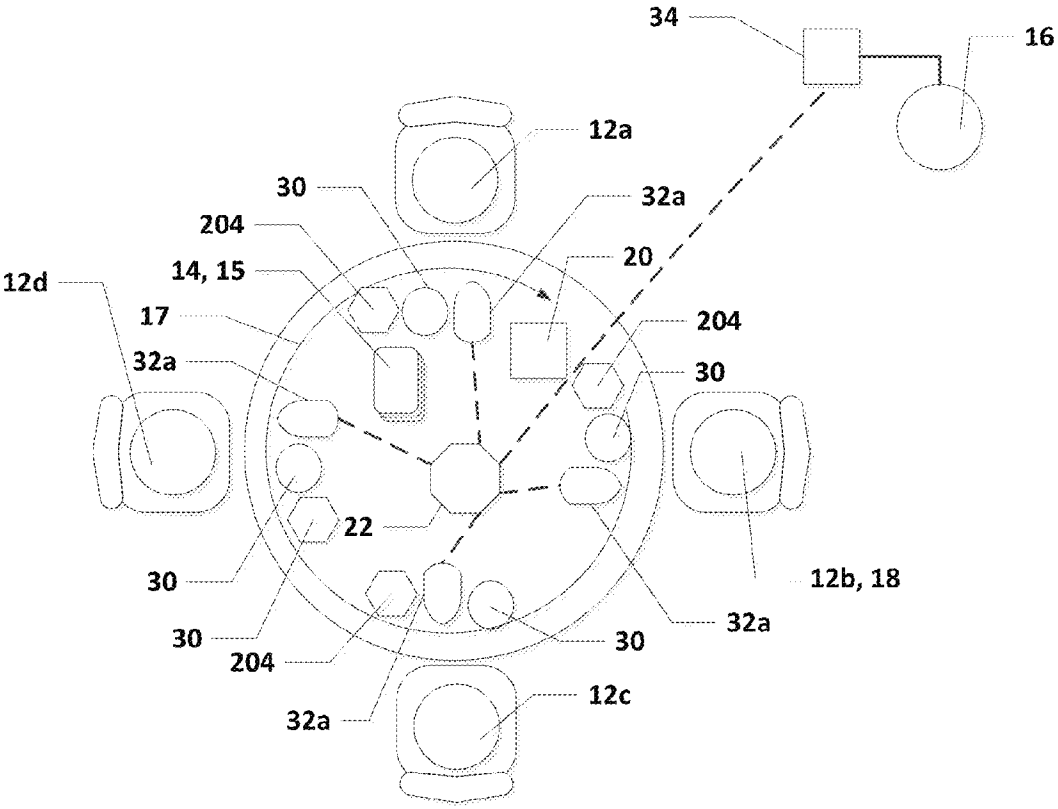
FIG. 1 is a schematic view of the method of playing a card game in accordance with one or more embodiments of the present invention.
Figure 4:
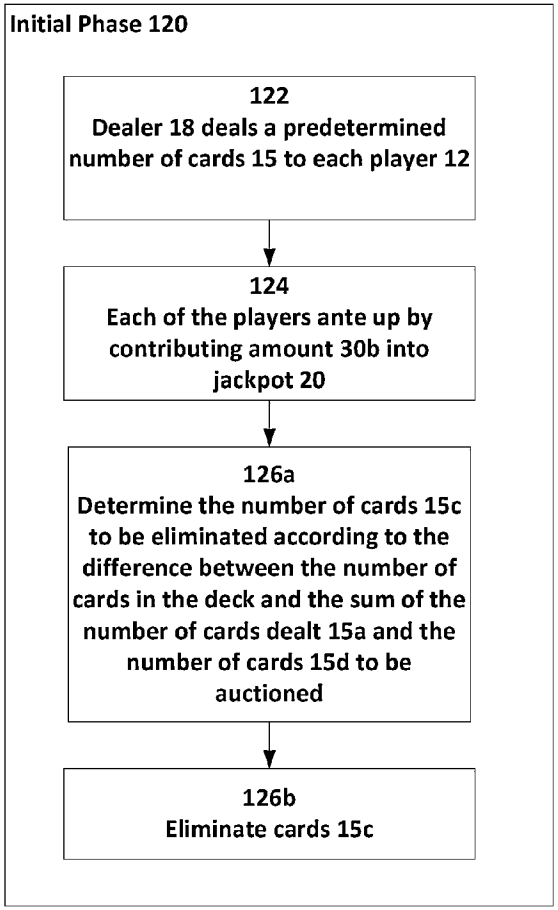
FIG. 4 is a flowchart of the initial phase of the method of FIG. 2.
Figure 3:
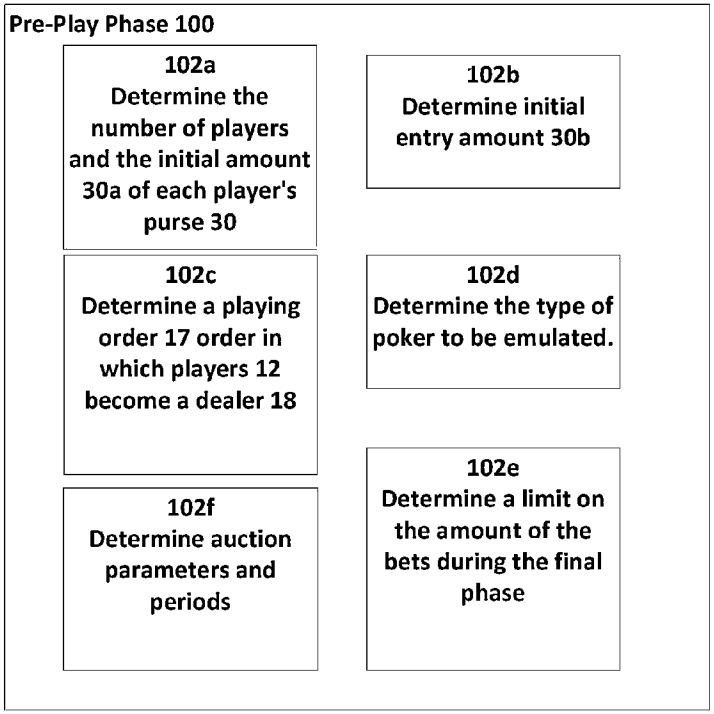
FIG. 3 is a flowchart of the pre-play phase of the method of FIG. 2.
Figure 7:
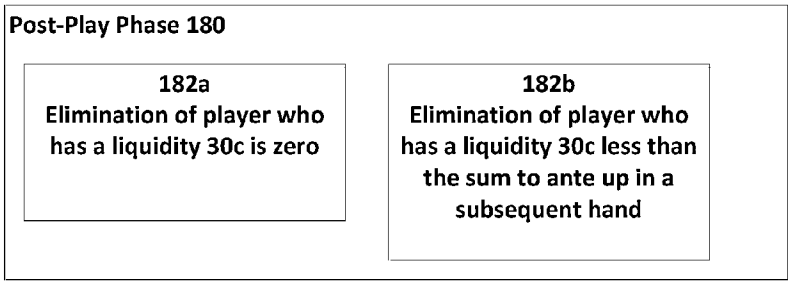
FIG. 7 is a flowchart of the post-play phase of the method of FIG. 2.
Figure 5:
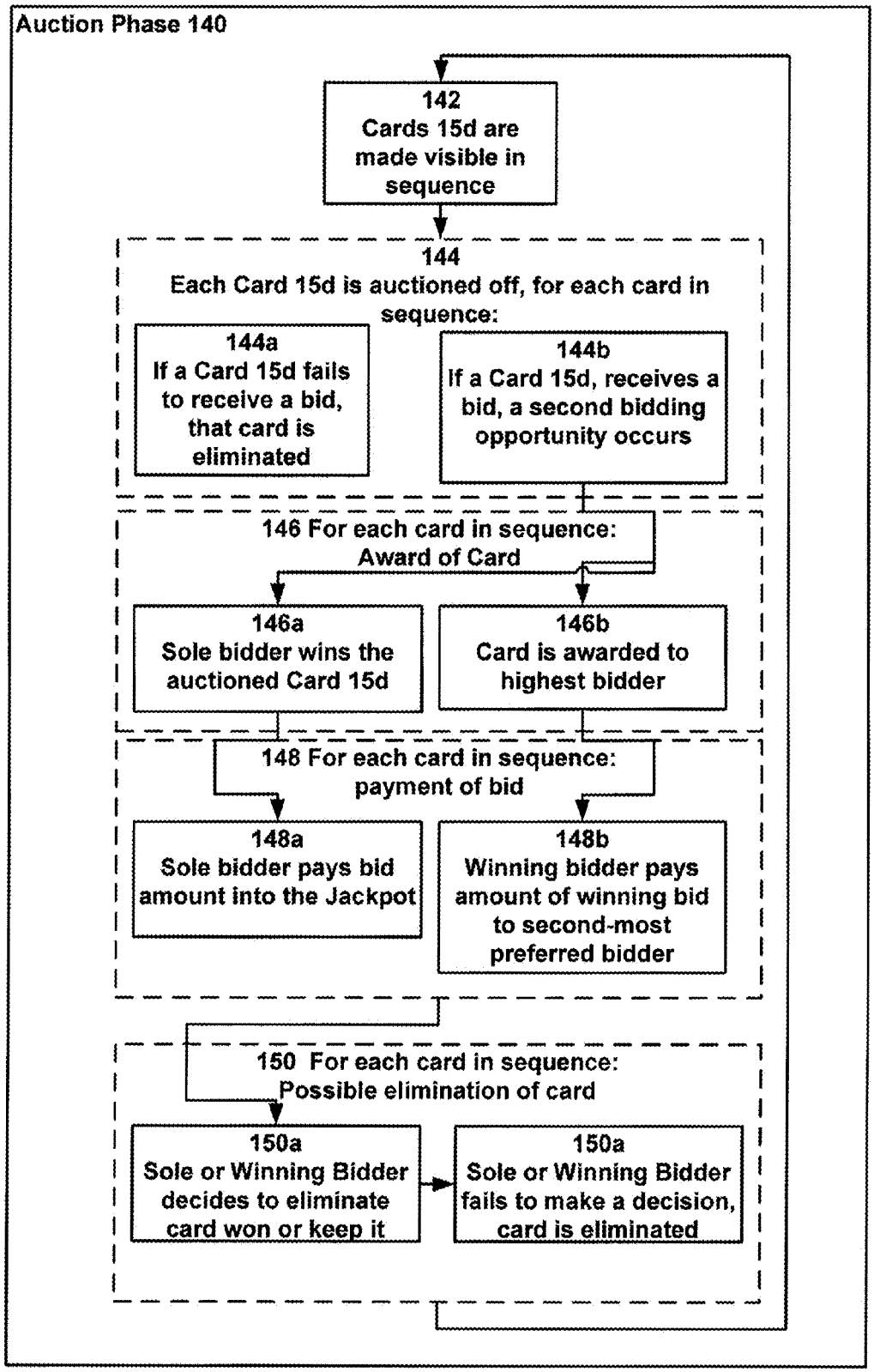
FIG. 5 is a flowchart of the auction phase of the method of FIG. 2.
Figure 5A:
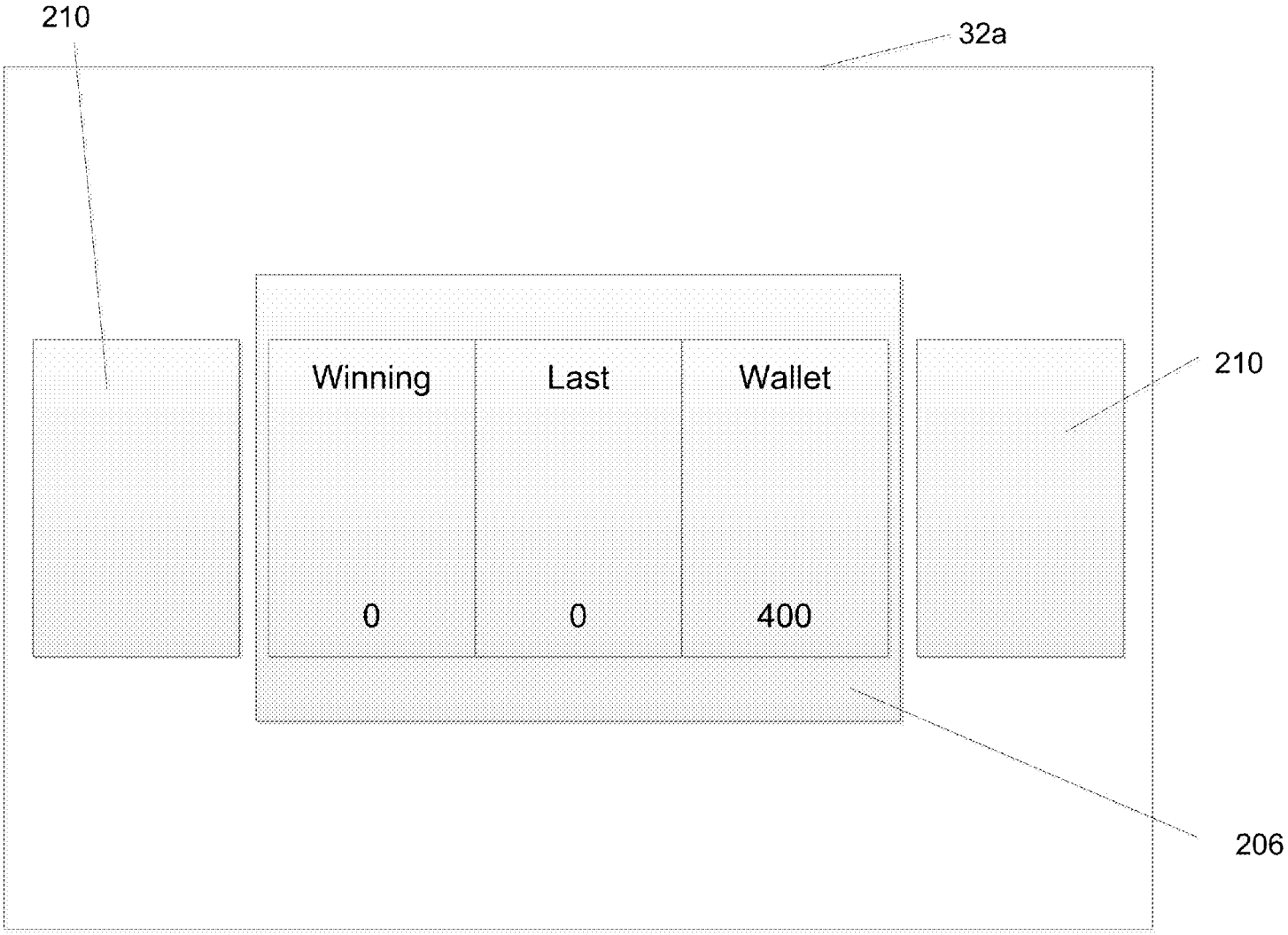
FIG. 5A refers to a casino (table) version of the game and is a sample display screen of a player shown to all the other players, at the beginning of the auction phase. Every (human) player at the table has one display screen visible to him and to all other (human) players.
Figure 5B:
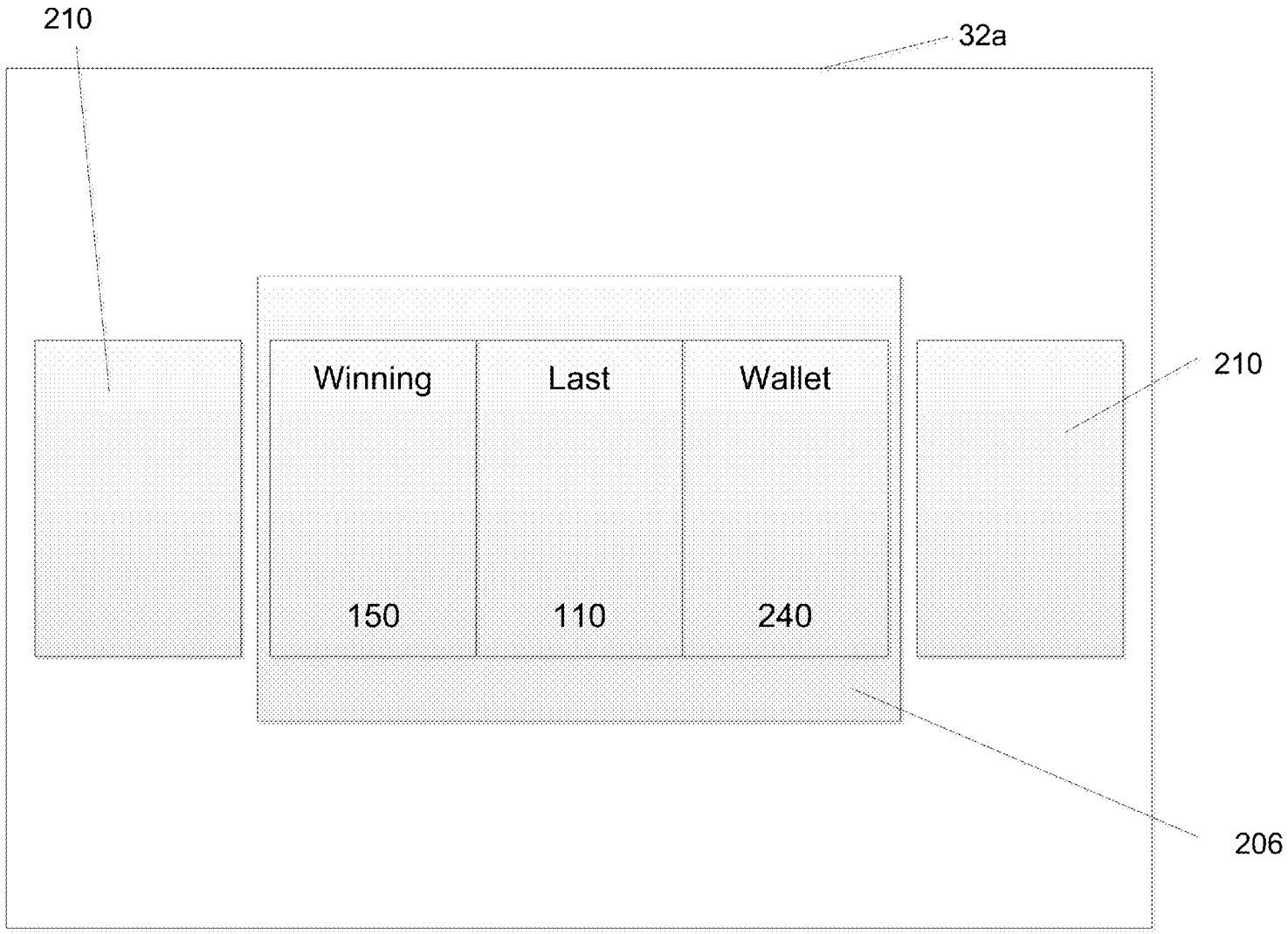
FIG. 5B refers to a casino (table) version of the game and is a sample display screen of a player shown to all the other players, during the auction phase (i.e. after one or more bids for an auctioned card, when other auctioned cards have already been purchased). Every (human) player at the table has one display screen visible to him and to all other (human) players.
Figure 5C:
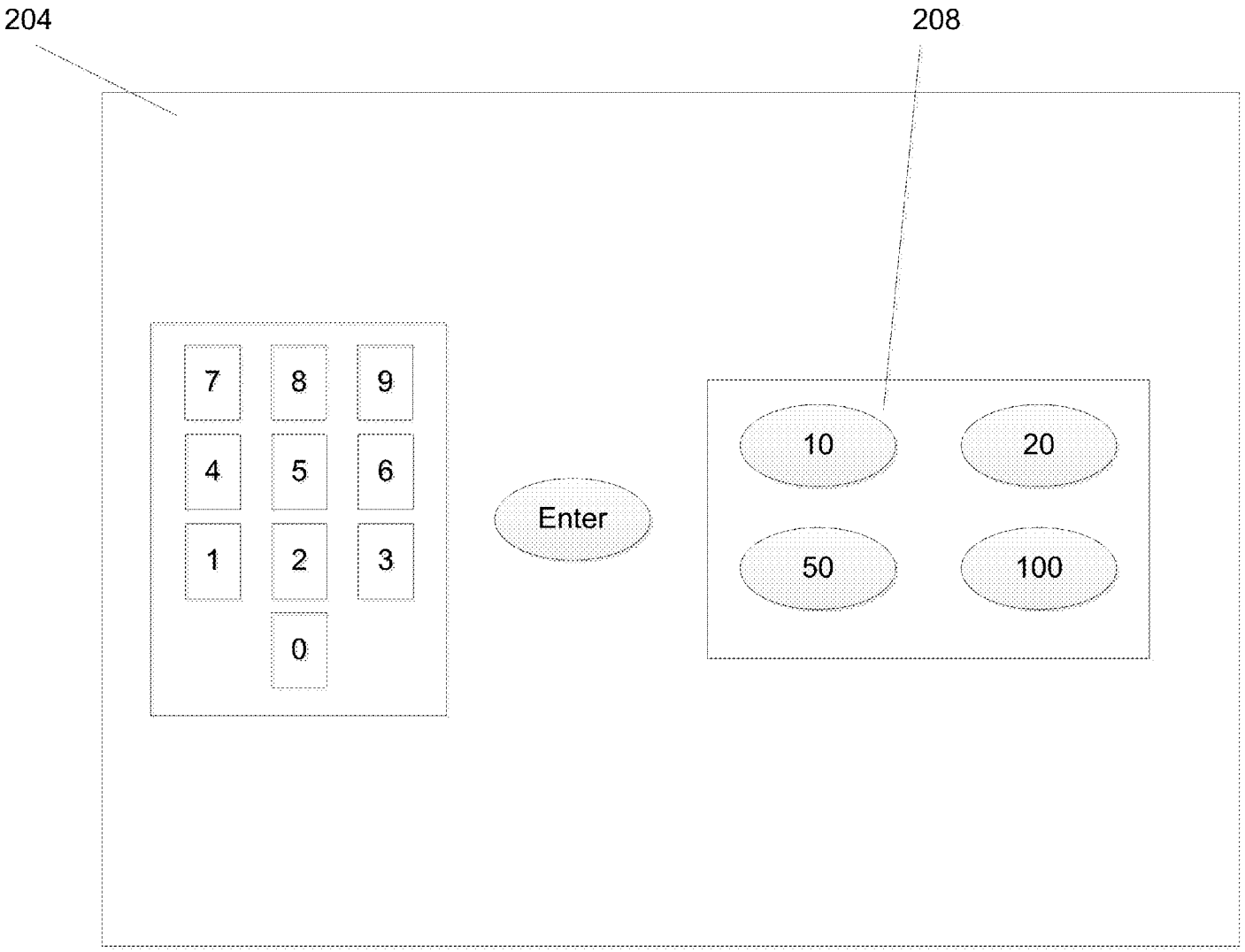
FIG. 5C refers to a casino (table) version of the game and is a keypad or a touch screen, which is integrated in the table and is connected with the computer which performs the auction phase and thereby with all the display screens. Each player at the table has his keypad (or touch screen) and uses them to enter bids during the auction phase.
Figure 5D:
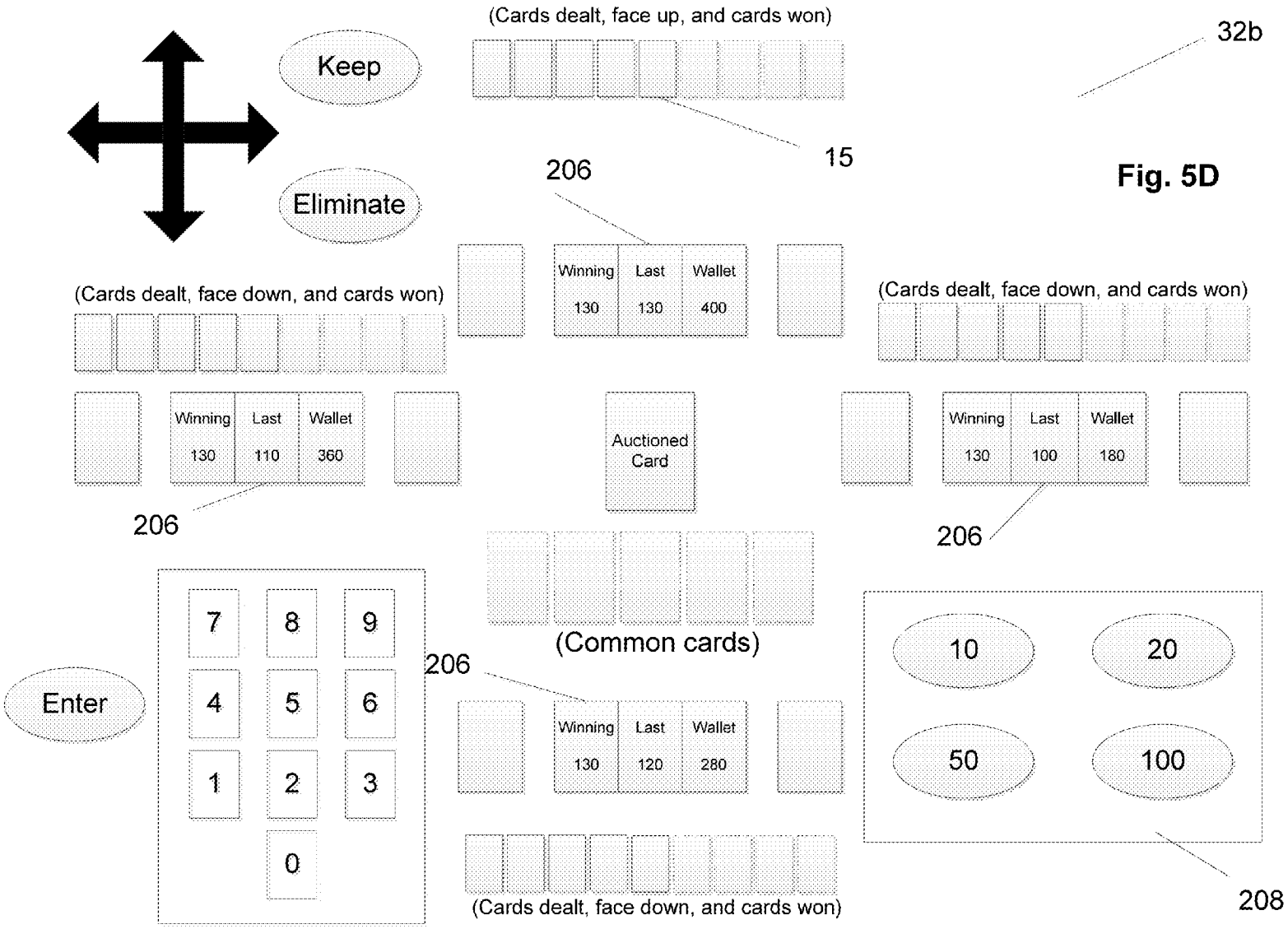
FIG. 5D refers to an on-line version or a video poker version of the game and is a sample display screen shown to a (human) player. The player uses the screen to track the progress of the game (for example: to know the bids and the status of the other players, either human or generated by the computer, during the auction phase). The screen is a touch screen (or has a keypad), so the player uses it to bid during the auction phase.
Figure 6:
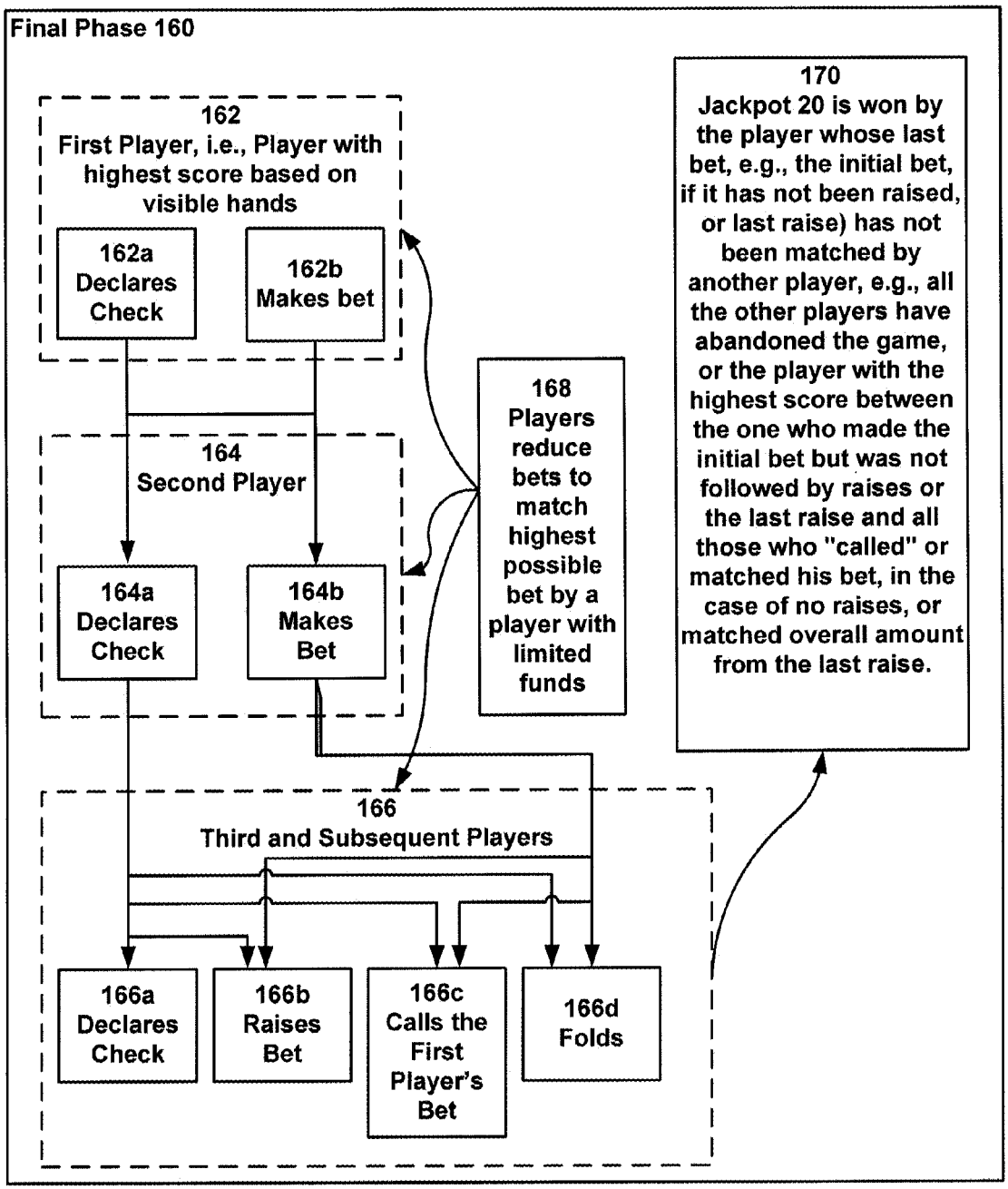
FIG. 6 is a flowchart of the final phase of the method of FIG. 2.

FIG. 1 is a schematic view of the method of playing a card game in accordance with one or more embodiments of the present invention. FIG. 2 is a flowchart of the method of playing a card game of FIG. 2. FIG. 3 is a flowchart of the pre-play phase of the method of FIG. 2. FIG. 3A is a sample chart of the selections made by a manager during pre-play phase 100. FIG. 4 is a flowchart of the initial phase of the method of FIG. 2. FIG. 5 is a flowchart of the auction phase of the method of FIG. 2. FIG. 5A refers to a casino (table) version of the game and is a sample display screen of a player shown to all the other players, at the beginning of the auction phase. Every (human) player at the table has one display screen visible to him and to all other (human) players. FIG. 5B refers to a casino (table) version of the game and is a sample display screen of a player shown to all the other players, during the auction phase (i.e. after one or more bids for an auctioned card, when other auctioned cards have already been purchased). Every (human) player at the table has one display screen visible to him and to all other (human) players. FIG. 5C refers to a casino (table) version of the game and is a keypad or a touch screen, which is integrated in the table and is connected with the computer which performs the auction phase and thereby with all the display screens. Each player at the table has his keypad (or touch screen) and uses them to enter bids during the auction phase. FIG. 5D refers to an on-line version or a video poker version of the game and is a sample display screen shown to a (human) player. The player uses the screen to track the progress of the game (for example: to know the bids and the status of the other players, either human or generated by the computer, during the auction phase). The screen is a touch screen (or has a keypad), so the player uses it to bid during the auction phase. FIG. 6 is a flowchart of the final phase of the method of FIG. 2. FIG. 7 is a flowchart of the post-play phase of the method of FIG. 2.

In a method 10 of playing a card game 2, a plurality of players 12 (e.g., 12*a*, 12*b*, 12*c*, etc.) are provided a deck of cards 14 having a plurality of cards 15 and a computer 22 which acts as a timing device and performs the auction phase.

The plurality of players attempt to win a jackpot 20 that is a sum of money, points, or credits contributed by the players from their respective purses 30 in the course of game 2. One or more players 12 may be a computer or non-human player, while one or more other players 12 are human players.

In one embodiment of the present invention (casino table version) each human player 12 is provided with a display device 32*a* that shows to him and to all other human players at the table, in every moment of the auction phase, the bids and the status of that player. In other embodiments of the present invention (on-line version or video poker version) each human player 12 is provided with a display device 32*b* that can be used to track the progress of game 2 and enter bids using a keypad and/or a touch screen device.

Card game 2 comprises at least one hand 4, but typically comprises a plurality of hands 4, wherein each hand emulates a poker hand in combination with a timed auction.

Method 10 comprises a pre-play phase 100; a playing sequence of an initial phase 120, an auction phase 140, and a final phase 160; and a post-play phase 180 if more than one hand is played. A hand 4 comprises at least the playing sequence of phases 120, 140, and 160.

At least two players 12 are required to play card game 2. Preferably, the number of players 12 is limited to between four (4) to eight (8) players in the initial phase. While it is possible to play with fewer than four (4) players, this makes the game less interesting, especially during the auction phase, to be described below, because it is more likely that an auction card 16*a* is not interesting for any or either player.

Deck 14 may be a deck of western playing cards, as illustrated herein, but may also be traditional cards having more or less cards or different types of cards than western playing cards. A deck of western cards, such as deck 14, includes 52 cards 15 divided into four (4) suites of 13 cards; e.g., suites: spades ("♠"), hearts ("♥"), diamonds ("♦"), and clubs ("♣"); and cards: numbered 2-10 inclusive ("2", "3", etc.), Jack ("J"), Queen ("Q"), King, ("K") and Ace ("A"). Two jokers are optional, constituting the 53rd and 54th cards of deck 14 when so desired, and may substitute for any other card. However, deck 14 preferably does not include the jokers.

In addition to the players, a manager 16 may be present or one of the players may be designated to be a manager. However, manager 16 is preferably not one of the players to ensure that one player cannot influence the pacing of card game 2. Manager 16 may be a casino, a game organizer and/or anyone else designated to manage or organize one or more card game 2 and/or one or more hands 4; manager 16 may comprise one or more persons or computers who may or may not be aware of each other. For example, manager 16 may be a table dealer as commonly found in a casino as well as the floor manager and any persons above or below any other person. If manager 16 is a person, manager 16 is provided with an input terminal 34 that can be used to control input criteria to be used during game 2. In this scenario, input terminal 34 is operatively coupled (e.g., through a network) to computer 22 and displays 32*a* in order to manage game 2. This allows input terminal 34 to control the behavior of computer 22 and displays 32*a* in order to provide a more interactive game. Also, because players 12 do not have access to input terminal 34, only the manager 16 can control the overall flow of game 2. If manager 16 is a computer (e.g., for online play), no input terminal is needed. Manager 16 may also be a regulatory or governmental agency or a group functioning in such a capacity or part of such a capacity.

Pre-play phase 100 proceeds at any time prior to initial phase 120. Therein, the players by consensus or fiat to determine certain administrative matters in one or more steps 102, e.g., steps 102*a* et al. Preferably, manager 16 of the game or hand may undertake to make such decisions.

In a step 102*a*, performed before, at the same time, or after any other step in this phase, manager 16 determines the number of allowed players. Manager 16 may also determine an initial amount 30*a* that is a sum of money, credits, or points to which each player's purse 30 is limited: during all the hands of the game each player will not be allowed to spend more.

In a step 102*b*, performed before, at the same time, or after any other step in this phase, manager 16 determines an individual entry amount, i.e., ante, 30*b* that is a sum of money, credits, or points that each player (regardless of who is the dealer) must ante in order to play hand 4. Therein, the total of each of the entry amounts 30*b* is jackpot 20. The selection of the ante by the manager 16 allows him to control the type of players that are desired at the table. For example, if the manager 16 selects a high/expensive ante, the manager is more likely to attract experienced players or "high rollers."

During a game and/or hand, purse 30 will comprise a liquidity 30*c* that represents the value of a player's purse at that moment and may be equal to zero. Money, credits, or points may be limited throughout the game to a predetermined amount given to each player so that the players do not simply dispose of points as valueless.

In step 102*c*, performed before, at the same time, or after any other step in this phase manager 16 determines a playing order 17 order in which players 12 become a dealer 18, e.g., deal one or more hands 4. In the alternative, manager 16 may be designated to be the dealer 18.

In step 102*d*, performed before, at the same time, or after any other step in this phase, manager 16 determines the type of poker to be emulated; for example, 5-draw poker, Texas Hold'em poker, or Omaha poker. In this step, manager 16 determines also, according to the kind of poker to be emulated, if there are or not rounds of betting before the auction phase and how many personal cards must remain hidden until the end of the hand.

In step 102*e*, performed before, at the same time, or after any other step in this phase, manager 16 determines a limit on the amount of the bets during the final phase.

In step 102*f*, performed before, at the same time, or after any other steps in this phase, manager 16 selects the parameters to be used during the auction phase: bidding period length and card decision period length. Only in the case of 2 or 3 players, manager 16 determines also the "wallet" for the auction phase, i.e. the limit to the amount that can be spent during the auction phase; in any other case this limit will be equal to the jackpot plus the sums the player received for being the second best bidder and computer 22 will automatically select it. Manager 16 may also determine the bidding period length for the final phase.

After manager 16 has selected the various criteria in steps 102*a*-102*f* which govern the logistics of each hand 4, the manager 16 inputs this information into computer 22 via an input device where it is stored in table 200 (FIG. 3A). Alternatively, if manager 16 is a computer, such as in an online poker game, this information is stored locally in manager 16.

For example, in order to cater to more instinctive and quick players, the manager 16 may set the bidding period length to be short (e.g., 3 seconds). However, if the manager desires a more rational and introspective game, the manager 16 may set the bidding period length to be longer (e.g. 5 seconds). The manager 16 may also vary the bidding period length, or any other criteria for each hand 2 that is played by players 12. By doing this, manager 16 does not allow the players 12 to settle into a rhythm.

Manager 16 may utilize input terminal 34 to input the various criteria in steps 102*a*-102*f*. In the example shown in FIG. 3A, the manager has selected the following parameters: four players, ante of $100 USD, a 4 second auction phase bidding period length, a 15 second "keep or eliminate" period length, a 15 second final phase bidding period length, and a maximum total bet in the final phase no higher than 1.5 times the jackpot.

As there is a limit to the money that can be spent during the auction phase (the reasons will be explained below), imposing limits to the bets in the final phase balances the game, and especially balances the importance of the auction phase and the final phase. Therein, preferably a maximum total bet, including raises, equal to the jackpot, for each player in the final phase is established. Alternatively, a maximum total bet no higher than 1.5 times the jackpot to favor bluffing.

In the absence of limits, there is the risk that movements of money in the auction phase will become irrelevant for the game results or, on the contrary, that too many players will concentrate on parasitic tactics during the auction and give up on betting during the final phase, depending on the type of players at the table.

In an Example A, a card game 2 includes four players, e.g., players 12*a*, 12*b*, 12*c*, and 12*d*. Manager 16 has decided that ante 20*b* is 100 credits resulting in jackpot 20 of 400 credits.

In initial phase 120, in step 122, dealer 18 deals a predetermined number of cards 15 to each player 12 in keeping with the kind of poker is determined. Thus, for example in Example A, if standard 5-draw poker game is to be emulated, each player 12 in hand 4 will be dealt by the dealer randomly five (5) cards 15, e.g., dealt cards 15*a*, face down so that the cards are visible only to the player who receives them. In Texas Hold'em poker, each player in hand 4 will be dealt by the dealer randomly two (2) cards 15, e.g., dealt cards 15*a*, face down so that the cards are visible only to the player who receives them and another five (5) cards are dealt randomly face up to a common pot for all players to see. In Omaha poker, each player in hand 4 will be dealt by the dealer randomly four (4) cards 15, e.g., dealt cards 15*a*, and another five (5) cards are dealt randomly face up to a common pot for all players to see.

In this application, visible means that the face value of the card is revealed, and invisible means that the face value of the card is not revealed.

In a step 124, each of the players ante up by contributing amount 30*b*.

Subsequently, cards 15 of deck 14 that have not been dealt, i.e., undealt cards 15*b*, are partially eliminated, i.e., eliminated cards 15*c*, immediately from the game without the players seeing them in a step 126*a* and 126*b*. The remaining undealt cards 15*b* are to be auctioned off, i.e., auction cards 15*d*, in auction phase 140.

The number of cards 15*c* to be eliminated is determined in step 126*a* according to the difference between the number of cards in the deck and the sum of the number of cards dealt 15*a* and the number of auction cards 15*d* to be auctioned. The cards to be auctioned may be provided as listed in Table 1. In step 126*b*, eliminated cards 15*c* are eliminated.

TABLE 1

Number of Cards to be Auctioned

| Number of Players | Cards to be Auctioned |
|---|---|
| 2, 3, or 4 | 8 |
| 5 | 9 |
| 6 | 10 |
| 7 | 11 |
| 8 | 12 |

Thus, in Example A, a deck having 52 cards wherein four players are dealt 5 cards each and 8 cards are to be auctioned will require 24 cards to be eliminated.

The numbers of cards to be auctioned listed in Table 1 guarantee a quick game, suitable for casinos or online gaming. Moreover, they balance perfectly luck and instinct with memory and calculation: the players see some cards and have some information, but not too many, so it is difficult to understand the hands that the other players are trying to attain and to understand if they have been successful or not. Moreover, they guarantee to all the players chances to attain a good hand (on average, at least four players can buy in the auction at least 2 cards each; if they were less, the players would soon lose interest in the auction phase and, therefore, in the final phase, because it would become immediately clear that they will not attain the hand they are seeking for), but don't guarantee to any player to attain the highest hands (if the auctioned cards were more, all the players would try to attain a royal flush or a four-of-a-kind, and the game would be too readable and monotonous).

The computer 22 will automatically auction the number of cards listed in Table 1. Authorizing manager 16 to vary the number of cards to be auctioned using input terminal 34 (or, if manager 16 is a computer, as in online gaming, storing locally other numbers in manager 16) could give flexibility to the game, but these operations must be done very carefully because of the problems cited above.

In auction phase 140, in step 142, the cards that were not eliminated from the game, cards 15*d*, and not dealt to the players are made visible in a step 142 by dealer 18 and auctioned off one by one in a step 144 by manager 16. Therein, auctioning means that when card 15*d* is made visible a bidding period starts for each player, wherein each player has a set period of time, preferably from 3-5 seconds as measured by computer 22, to make his bid to buy the card. The time limit used by computer 22 was previously specified by manager 16 during pre-play phase 100 and stored in table 200 (FIG. 3A).

If no bids are made in the within the time set, in step 144*a* the card is "burnt," i.e. is eliminated from the game without ever being seen by the players again.

If a player makes a bid within the established time, the same amount of time is allowed for all players for a new and higher bid in a subsequent step 144*b*. For example, the established time is 4 seconds and the first bid arrives after 2 seconds from the auction start: in that moment a second bidding period of 4 seconds starts for raises and it will end after 6 seconds from the auction start; this continues in an auction fashion. If a second bid is not made, the card is awarded to the sole bidder in a step 146*a*, who must pay the amount bid into the jackpot, thereby increasing the jackpot in a step 148*a*.

In one embodiment (casino table version), the players 12 enter bids using a keypad or touch screen 204, integrated in the table, provided for each player 12. The players 12 can press the numeric buttons of the keypad or the touch screen 204 and then press a "return" or "enter" button to submit the bid; the players 12 can also bid and raise by pressing buttons having fixed values (e.g. $10, $20) using bid buttons 208 which don't require the "enter" button, as shown in FIG. 5C. In this way, the players 12 can bid rapidly, with only one touch. A sample display screen at the start of bidding is depicted in FIG. 5A. As shown, display screen 32*a* of player 12*a* displays a status bar 206 which displays only the "wallet" for the auction phase, i.e. the amount that player 12*a* can spend during the auction phase. A sample display screen after one or more auctioned cards and after one or more bids for an auctioned card is depicted in FIG. 5B. As shown, display screen 32*a* of player 12*a* shows a status bar 206 which displays the highest winning bid, the best bid made by player 12*a* and the "wallet" of player 12*a* in that moment.

In other embodiments (online version, video poker version) the players 12 enter bids using a touch screen 204 integrated in the display 32*b* (see FIG. 5D) or a keyboard connected with it: human player 12*a* has a display screen 32*b* which shows him, about each player 12*a*, 12*b*, 12*c*, 12*d*, etc. . . . (players 12*b*, 12*c*, 12*d* may be human players connected with him or players generated by the computer 22), the status bar 206 and the indicators 210 (see below). Of course, display 32*b* shows to the human player 12*a* the cards dealt to him (which are face up), the cards dealt to each of the other players 12*b*, 12*c*, 12*d* etc. (which are face down), the card that is being auctioned (face up) and the cards that each player has already purchased during the auction phase (which are face up and remain face up until the end of the hand). If, according to the kind of poker that is being emulated, there are common cards, display 32*b* shows these common cards (face up). If display screen 32*b* is a touch screen, the players will bid and raise using the numerical buttons and the enter button of the screen, or using the bid buttons 208 of the screen. When the player 12*a* has been awarded an auctioned card, the player will eliminate it, or keep it substituting one of his personal cards, using specific buttons of the touch screen (see FIG. 5D). If display 32*b* is not a touch screen, player 12*a* will bid, raise and keep or eliminate cards using the keyboard of the device he uses for online gaming or the keyboard of the video poker machine.

The bids entered on screens 32*a* or 32*b* are all recorded by computer 22. The computer 22 doesn't accept bids made after the end of the bidding period.

If two or more bids are made, the card is awarded to the highest bidder in a step 146*b*, who pays the amount bid for the card to another bidder having the second-highest bid in a step 148*b*.

During the auction process, display 32*a* or display 32*b* displays, for each player, a status bar 206 containing at least the highest winning bid, the player's last bid, and the amount available in his "wallet" (FIGS. 5A, 5B and 5D). In some embodiments, each display 32*a* has indicators 210 that are visible to all the players. For example, in the case of a casino table version, the display 32*a* of the player 12 with the current highest bid may have an indicator displaying green and the display 32*a* of the player 12 with the second highest bid may have an indicator displaying red. As the bidding progresses, the computer 22 changes the indicators 210 accordingly to reflect the player with the current highest bid and the second highest bid. In the case of online version or video poker version, the display 32*b* of the human player 12*a* shows indicators 210 for each player, so he knows immediately who is the best bidder and who is the second best bidder, without having to read all the status bars 206.

The indicators 210 may also be utilized to indicate the winner of the auction. For example, if player 12*b* has won the auction, his indicator 210 may blink green thrice to indicate the end of the auction for a particular auction card 15*d*; and the player with a red indicator at the end of the auction (the second-highest bidder) is awarded the sum of the winning bid to his purse 30 and to his "wallet" 36.

Because the auction phase 140 proceeds very quickly and displays 32*a* must be updated in real time to show the bid amounts, it is necessary that the process is entirely automated (e.g., by computer 22). It is not feasible for a human to control the automation process due to the short bidding period length of the auction for each card 15 (auction bidding period length of 3-5 seconds) and to the many bids that can be made in a very short time using the fixed value bid buttons 208. Only a computer can put the many bids in chronological order, identifying in every moment who is the best bidder and who is the second best bidder. Also, by having a computer control auction process 140, the process will proceed smoothly because the computer will be able to keep the timing consistent unlike a human auctioneer, giving each player exactly the same time to bid. Also, every time that an auctioned card is awarded to the best bidder, the amount of the bid must be awarded to the second-best bidder: only a computer can calculate immediately what happens in the "wallet" of the two players (the best bidder, whose "wallet" decreases, and the second-best bidder, whose "wallet" increases of the amount bet by the first). Moreover, as the "wallet" is the limit to the amount that can be spent during the auction phase, only a computer can control that each player doesn't spend for the auctioned card more than the limit, i.e. more than there is in his "wallet" in that moment, automatically excluding raises over the limit. The computer 22 calculates the "wallet" adding to the jackpot (i.e. the ante multiplied by the number of players, which are inputs of steps 102*a* and 102*b*, plus the sums added to the jackpot in the case of a sole bidder) the sums that the player received for being the second best bidder.

In an Example B, unrelated to other examples, a player 12*a* bids ten points for an auction card 15*e* and players 12*b*, 12*c*, and 12*d* do not make a bid. Thus, player 12*a* pays ten points into the jackpot.

In an Example C, unrelated to other examples, a player 12*a* bids 20 points, a player 12*b* bids 30 points, a player 12*c* bids 40 points. Thus, player 12*c* pays 40 points to player 12*b*.

What the player who is awarded the auction card does with the auction card depends on the version of poker that is being emulated. In 5-draw poker, the player who wins the card can decide, within the maximum period of time established by manager 16 in table 200, preferably from 15 to 30 seconds, if he wants to keep it or "burn it," e.g., eliminate the card, in a step 150, i.e., step 150*a*. If the player keeps the card, the card will substitute one of the cards he already holds at the player's discretion and remains visible to all the players for the entire hand unless it is eliminated later when substituted by a newly purchased card.

If Texas Hold' em poker is emulated, method 10 preferably includes a step wherein the auctioned card or cards do not substitute for one of the two cards dealt face down to the player who won the bid. Otherwise, in the final phase, all or all except one of the cards available for that player could be visible to the other players. If Omaha poker is emulated, method 10 preferably includes a step wherein when one player makes multiple winning bids, the third and subsequent auctioned card cannot substitute one of the cards dealt face down to the player who won the bid. In this way, at least two dealt cards 15*a* are visible only to the player to whom cards 15*a* were dealt and must remain hidden from all other players until the end of the hand. Thus, when it is not possible to substitute a face-down card, the auctioned card, because the auctioned card must remain visible to all players, either substitutes a face-up card if existing or is added to the cards dealt to the player who won the bid, at the discretion of the player who won the bid. The winning hand is made using only five cards among those available to the player, using cards dealt to the player, cards common for all players if so existing, cards awarded in the auction. Therein, it depends on the variation of poker that is being played how many personal cards and how many common cards have to be used. Moreover, in the initial phase, all the cards are dealt in that type of poker are appropriately dealt, i.e., cards that are face up or face down are dealt to the player and, if existing, cards common to all players. The manager 16 must decide before the beginning of the hand (in step 102*d*) how many personal cards must be hidden until the end of the hand, according to the kind of poker that is being played.

According to the kind of poker that is being played, the manager 16 must also decide, before the beginning of the hand (in step 102*d*), if there are or not rounds of betting before the auction phase: a round of betting is preferably conducted when there are cards visible to all players when playing Texas Hold' em, Omaha, or Stud poker.

If the player who won the card decides to eliminate it, the card won in the auction is eliminated from the game in a step 150, e.g., step 150*a* and can no longer be seen by the players. If the player does not choose within the maximum time allowed in step 150*a* to eliminate the card, the card won is automatically eliminated in step 150*b*.

Steps 142-150 are repeated until all cards 15*d* are auctioned off.

In auction phase 140, each player is limited to an amount ("wallet" 36) that is no greater than the jackpot for purchasing cards plus, if applicable, any sums that player received for being the second-best bidder.

Preferably, during auction phase 140, each player is limited to an amount equal to his residue liquidity when the player's liquidity 30*c* is less than the jackpot. Liquidity 30*c*, as well as the "wallet" 36, are increased only when the player is the second highest bidder, for a card being auctioned off.

Once purse 30 of a player has a liquidity 30*c* equal to zero, that player can no longer make any bids to purchase cards. Likewise, a player cannot make bids higher than liquidity 30*c* in that player's purse 30.

Advantageously, the "wallet" 36, i.e. the limit on the amount that can be spent during the auction phase, immediately obstructs tactics, even if irrational, of hoarding, at any cost, of unbeatable hands, which dampen all interest in the final phase. This encourages players who adopt parasitic tactics to participate in the auction for speculative purposes and also encourages players who aim to win the jackpot but who need more cards to attain a winning hand because they need greater liquidity for acquiring cards. Preferably, the limit must be equal to the jackpot, plus the sums received for being the second best bidder, in order to encourage players to participate in the auction for speculative purposes, giving at the same time the right importance to the auction phase and balancing it with the importance of the final phase. The computer 22 will automatically impose this limit. Authorizing manager 16 to vary the limit using input terminal 34 (or, if manager 16 is a computer, as in online gaming, storing locally another limit in manager 16) could give flexibility to the game, but these operations must be done very carefully because of the reasons cited above.

Only in the case of two or three players, the manager 16 may reduce the limit, for example deciding that the spending limits on the auction will not exceed half of the jackpot, plus the sums received for being the second-best bidder; in the case of 2 or 3 players it is useful to lower the limit because otherwise the movements of money during the auction phase will make irrelevant the final phase: the player or players who have been awarded more money for being the second-best bidder (and have purchased few cards) have increased a lot their purse 30 but they have no chance to win the final phase, so they will not participate in it. The manager 16 will input this decision in step 102*f*.

Final phase 160 begins when there are no cards 15*d* left to be auctioned. Then, in a step 162, the player who has the highest score, based only on the visible cards, may declare that he wants to play for the jackpot as it is, i.e., "check," in a step 162*a* or may make his own bet in a step 162*b*.

If the player who has the highest score has declared he wants to check in step 162*a*, the next player in a clockwise rotation may second the check in a step 164*a* or may decide to make a bet in a step 164*b*.

If the second player has decided to make a bet in a step 164*b*, the next player in the clockwise rotation may raise the bet in a step 166*b*, call the first player's bet by matching the first player's bet in a step 166*c*, or abandon the hand, i.e., "fold" in a step 166*d*. If the second player has decided to declare check in step 164*a*, the third player may declare check in step 166*a*, or undertake steps 166*b*, 166*c*, or 166*d*. Subsequent players in the clockwise rotation will then be called in order to choose one of steps 166*a*, 166*b*, 166*c* or 166*d* until rotation 17 returns to the first player, i.e., the player who has the highest score. Preferably, each user 12 utilizes buttons shown on display 32*b* to indicate if the player desires to check, fold, or call the hand. This is necessary in the case of online gaming or video poker version.

During final phase 160, no player is allowed to raise an adversary who has bet all his remaining liquidity, i.e., liquidity 30*c*. If the bet of one or more players exceeds the liquidity 30*c* of a player that, due to his position at the table, must still speak, the player who has insufficient funds preferably has to be compelled to choose between two alternatives. The player can fold in accordance with step 166*d* and in this case the other players' bets will remain valid; otherwise, the player with insufficient funds will have to bet all his remaining funds, i.e., liquidity 30*c*, in step 166*c*, and the other players will be obliged to reduce their bets to match his betting amount in a step 168.

Therein jackpot 20 is won in a step 170 by the player whose last bet, e.g., the initial bet, if it has not been raised, or last raise, has not been matched by another player, e.g., all the other players have abandoned the game, or the player with the highest score between the one who made the initial bet but was not followed by raises or the last raise and all those who "called" or matched his bet, in the case of no raises, or matched overall amount from the last raise. If all the players have declared they want to check, the hand with the highest score wins according to the below hierarchical hands.

Preferably, if a player uses the entirety of his liquidity 30*c* during the auction phase, the player is obliged to participate in the final phase and the other players cannot bet any amount, e.g., all players must check. If the player does not win the final phase, he is eliminated from the game as disclosed further below.

Advantageously, having a player with a liquidity 30*c* of zero strongly influences the freedom and expectations of the other players, but also creates greater interest in the auction since players who aspire to win the jackpot must also consider the possibility of "enriching" a nearly bankrupt player by systematically raising the nearly bankrupt player's bids in order to win a potentially richer jackpot.

Similarly, also step 168 influences the freedom of the others players and could disturb the flow of the game. Steps may be taken to mitigate such effect. For example, the player making an "all in" bet less than his adversaries if he wins, cannot receive an amount greater than his bet from each adversary.

In post-play phase 180, a player whose liquidity 30*c* is zero during the final phase is eliminated from the game in a step 182*a* prior to playing another hand. Likewise, a player who has a liquidity 30*c* of less than the sum required to ante up in a subsequent for the next hand is eliminated from the game in a step 182*b*.

Herein, the manager of the game may end the game by cancelling subsequent hands when the surviving players, i.e., players who have not been eliminated, are below a preferred number of players, e.g., 2 or 3. Thus, the player who, at that moment, has the greatest liquidity 30*c* is then the winner of the game and receives the eventual awards established by the manager.

The post-play phase 180 may be followed by another game 2 or hand 4.

Card game 2 is suitable for tournaments, wherein successive levels depending on the liquidity of the players at any given moment and/or eventually increasing the ante amount during the course of the tournament to force players to quit and, if the final objective is to arrive at a one-on-one final, changing the amount that can be used during the auction in relation to the jackpot. In general, in the form of "cash game," as well as obviously in the form of a tournament with winnings and losses set according to the classification of the tournament, this game tends to limit the losses of less talented or unlucky players, allowing them to vary their survival strategies. The game manager can always vary the amount to play each hand in order to obtain the desired effects.

The hierarchy of hands, in decreasing order, are straight flush, poker (four-of-a-kind), full house, flush, straight, three-of-a-kind, two pairs, pair, and high card. The following rules about the hierarchy of hands are preferable (but not necessary) because they maximize the importance of some cards (usually, the cards having the suit: hearts), so making the auction phase more interesting. Anyway, it is possible to use the normal rules, according to the kind of poker that is being played and the country in which it is being played.

A straight flush consists of five contiguous cards of the same suit, for example: 8-9-10-J-Q, all diamonds. The highest straight possible is 10-J-Q-K-A. The lowest straight has the Ace as the lowest card; for example, in the case of a 52-card deck (where the lowest card would be the 2): A-2-3-4-5.

When comparing straight flushes, the hand with the highest top card wins, but the lowest straight wins over the highest straight (while it loses to all the others). When comparing straight flushes with the same high card, the winning hand depends on the suit, for which there is a decreasing order of hearts-diamonds-clubs-spades.

A poker (Four-of-a-kind) consists of four of the same card, for example: J-J-J-J. When comparing pokers, the hand holding the card with the highest value wins.

A full house consists of three-of-a-kind and a pair; for example: Q-Q-Q-10-10. When comparing full houses, the hand with the highest three-of-a-kind wins, for example, J-J-J-9-9 wins over 10-10-10-A-A.

A flush consists of five cards of the same suit, but not in contiguous order, for example, 8-9-J-Q-K, all spades. When comparing flushes, the winning hand depends on the suit, for which there is a decreasing order of hearts-diamonds-clubs-spades. When comparing two flushes of the same suit, the flush with the highest card wins.

A straight consists of five contiguous cards, but not all of the same suit. The highest straight possible is 10-J-Q-K-A. The lowest straight uses the Ace as the lowest card; an example when playing with a 52-card deck would be: A-2-3-4-5. When comparing straights, the hand with the highest top card wins. In contrast to straight flushes, the lowest straight never wins over the highest straight (and therefore loses to all other straights). When comparing straights with the same high card, the winning hand depends on the suit, for which there is a decreasing order of hearts-diamonds-clubs-spades.

A three-of-a-kind consists of three of the same cards, for example: A-A-A. When comparing three-of-a-kinds, the card with the highest value wins.

A two pairs consists of two pairs of cards, for example: A-A-9-9. When comparing hands with two pairs, the pair of cards with the highest value wins, for example, A-A-5-5 wins over K-K-Q-Q. If the pairs with the highest value are the same, the second pair with the highest value wins: for example, K-K-10-10 wins over K-K-8-8.

If the two pairs are identical, the hand in which the pair with the highest value contains the hearts wins.

A pair consists of two of the same card, for example, for example: Q-Q. When comparing pairs, the pair with the card of the highest value wins; for example 10-10 wins over 7-7. When comparing pairs of equal value, the pair containing the hearts wins.

If none of the players has attained any of the previous hands, the player with the highest card in his hand wins. For example, A-4-6-8-9 wins over K-Q-J-9-8. If the card with the highest value is identical, the card with the highest value according to the hierarchy of suits wins, always in the decreasing order of hearts-diamonds-clubs-spades.

Herein, the hierarchy explained above may be varied to make it correspond to that used in variations of poker more common in the place where the game is being played, thereby satisfying the tastes and habits of local players. For example, the game manager 16 may impose the classic rule by which equivalent hands, for example, flushes, two pairs the same, are decided by the highest card present in the flush or by the fifth card in the case of a comparison between two pairs. This would make the game slightly less readable, because winning would depend more on the adversary's invisible cards, while assigning the hierarchy according to the suit makes the value of the cards up for auction more explicit, resulting in a more heated auction. A greater readability of the game attained through the hierarchy of hands is therefore generally considered an advantage, given that making the game less readable can be easily attained by reducing the number of cards put up for auction.

However, preferably, there is always a hierarchy for comparing the hands so as to avoid having to split the winnings among more than one winner: this contributes to maintaining the importance of the auction and clarifies the maximum value of the cards put up for auction.

Advantageously, the most important feature of this game, in addition to the enjoyment typical of games of chance, is the speed and the rhythm: the game obliges the player to change his strategy quickly and several times during a hand, with the risk of losing control over how much he is spending or the risk of spending during auctions for a single card in comparison to the actual amount staked.

For this reason, players preferably must have, naturally in addition to a minimum of luck, good memory because various cards are made visible, psychological introspection to "read" the strategies of the other players, and quick decision-making and calculation skills.

At least three different versions of the game are possible: Casino table version (with croupier), Casino or public establishment videogame version, and online version.

Therein, the essential function of the computer, which must be present in all the versions, is the capacity to allow a set period of time, preferably 3-5 seconds, to bid on individual cards, excluding bids made beyond the time limit and chronologically ordering the bids made, so that when the auction for a single card ends (because no other bids have arrived within the set time period), all the players can immediately and visually understand which player made the highest bid and which player made the second-best bid. If only one bid is made, it must obviously be visually clear to all the players that only one bid was made and who made it.

The computer 22 must allow the manager 16 to adjust the bidding period of the auction phase. If he extends the time limit, the game tends to favor the rational, calculating, and introspective components; if he reduces the time limit, the game moves faster and takes on a more instinctive connotation.

Because the displays 32*a*, computer 22, and manager 16 are all connected, the auction phase can be conducted much more quickly than if manager 16 had to keep track of all the bids by hand; in any case, manager 16 would never be able to do it in the case of many bids in a short time and he would never be able to give each player the same time to bid. Also, because each display 32*a* has an indicator and displays the current bid status, each player can make more informed bidding decisions.

The computer 22 allows an automatic calculation concerning the overall betting limits, above all during the auction phase and in the final phase, thereby automatically preventing the player from bidding a sum greater than his "wallet" at the auction, for example.

In accordance with one or more embodiments of the present invention, game 2 preferably balances luck and skill, e.g., mnemonic, mathematical, and psychological introspection. Therein, one or more variations are possible. For example, it may be possible to introduce a number of cards to be visualized from the dealing of the cards.

In accordance with one or more embodiments of the present invention, method 10 may include varying the number of cards dealt, or those visible only to the player who has received them, and introduce cards common to all the players.

In accordance with one or more embodiments of the present invention, method 10 may include keeping the "burnt" cards visible for the entire duration of the game.

In accordance with one or more embodiments of the present invention, method 10 may institute an auction with "one-off" bids, e.g., no raising, and/or with a secret bidding procedure.

In accordance with one or more embodiments of the present invention, method 10 may always add the amount bid to the ante or use the bids for a jackpot to be won at the end in relation to the points attained by the winning player.

In accordance with one or more embodiments of the present invention, method 10 may require that the amount of players' bids can be deposited in the jackpot even if the player did not win the card.

In accordance with one or more embodiments of the present invention when it is decided to play with fewer than 52 cards, preferably the lowest cards (the 2, then 3, etc.) are eliminated first. Advantageously, these advisable values concerning the number of cards to be used and, later, the number of cards to be auctioned determine a balanced proportion among the various hands that the player can attain (for example and in particular, full house, flush, or straight) coherent with the hierarchy of the same and with the probability of reaching them, so that there is no hand that, due to probability and hierarchy, becomes an essentially obligatory objective for all the players, being the one that would guarantee the winning of nearly all the hands (in other words, of the individual games). Even the potential existence, however, of imbalances in favor of a particular hand, if on one side may make the game more routine and less interesting from certain points of view, on the other it may be compensated for by the greater "readability" of the adversaries' game, resulting in a more combative auction phase, as described below.

By using fewer cards than the standard 52 cards in a deck while maintaining the same number of cards that are auctioned, higher hands (especially poker and full) can be attained by all players. For example, with 4 players using a deck of 44 cards and putting 8 up for auction, more full houses can be had and poker will not be a rare occurrence.

The effect can be reduced or annulled by cutting the number of cards put up for auction: in the example, reducing them to 6 or fewer.

In fact, there are different points of balance, obtained by associating a number of cards that make up the deck and a number of cards to be auctioned off, which produce similar effects on the level of hands players may attain. For example, with 4 players, playing with a deck of 44 cards and putting 8 up for auction is essentially equivalent, in relation to the hands normally attainable, to playing with 48 cards and putting 9 up for auction, or with 40 cards with 7 up for auction.

Preferably, the entire deck of 52 cards is used, because it would, in any case, be necessary to have a maneuvering margin on the number of cards to be auctioned off in the case of 8 players, and to avoid a full house from having too great an advantage over the flush. With 52 cards, the probability of obtaining a full house is not much lower than the probability of attaining a flush, and the gap is further reduced by cutting the number of cards in the deck (to the point of being null and inverted); considering that with 52 cards the full house must win over the flush, reducing the number of cards in the deck from 52 to—for example—44, the players will be obliged to give up hopes for a flush, given that with all probability, at least one adversary will counter with a full house. Unless an excessive number of cards is auctioned off (which would make it easy to attain even pokers and straight flushes), the full house will then become a normally winning hand to be sought by all the players.

Furthermore, a full house has two more advantages over the flush: it can often be attained by acquiring only two cards (it would suffice to have a pair in the five cards dealt, which is quite common, and in any case more common than having three cards of the same suit), and it is an easier hand to hide, because the two cards have no apparent relationship between them (while the attempt to acquire a second card of the same suit would immediately alarm the other players and cause their opposition during the auction).

Preferably, greater readability of the game can make the auction more interesting (all the players know that their adversaries are seeking a full house, and will therefore seek to obstruct him from acquiring a second card, whatever it may be), but the effect is partial, because there is no certainty about which full house the adversaries are seeking (and it is therefore difficult to distinguish the sincere interest in acquiring a card from merely participating in the auction for speculative purposes. So it may happen that the hand is attained with the acquisition of a card other than those that had found greater opposition on behalf of the adversaries). Using a full deck of 52 cards, therefore, guarantees a chance at a flush and to the players who try to attain it, thereby preventing an important and somewhat readable hand that tends to "fuel" the auction from essentially being excluded from the game.

Preferably, a small number of players (2, 3) is avoided. With two players, in general, the card game changes considerably. The players become encouraged to act more cautiously in that the player who pays more for the first cards, when there is a limit to the overall purchase price, would be helpless when compared to his adversary because he would have much less liquidity to purchase the remaining cards. This would allow his adversary to buy, and at reduced prices, all the cards that truly interest him.

Therein, the relationship between the auction phase and the final phase varies considerably in that the movement of money (or points) during the auction phase tend to exceed the winning of the ante: it is in fact probable that a player, as soon as he realizes he cannot attain a winning hand, will adopt a parasitic tactic and immediately give up betting in the final phase, by which the player aspiring to win will not find an adversary willing to raise the stakes. This effect, to a lesser extent, may also occur in the case of 3 players. In brief, players tend to weigh the pros and cons, and calculation skills and rationality tend to be rewarded.

While the invention has been described in conjunction with specific embodiments, it is to be understood that many alternatives, modifications, and variations will be apparent to those skilled in the art in light of the foregoing description.

What is claimed is:

1. A method of playing a card game, the card game comprising a plurality of players competing for a jackpot contributed by the plurality of players, each player having access to a respective display and a respective keypad or a touchscreen, the method comprising the steps of:

performing by a computer an auction phase, the auction phase comprising the steps of (a) displaying a face value of an auction card to each player on the respective display;

(b) auctioning the auction card in a bidding period;

(c) (i) eliminating the auction card when none of the players makes a bid for the auction card, (ii) if a bid is made, entering the bid by at least one player using the respective keypad or touchscreen, receiving by the computer from the at least one player the bid on the auction card, displaying on the respective display to the player with a current highest bid an indicator of in a first color; and (d) ending the auction of the auction card after the bidding period when no additional bids are received;

(e) if there was only a single bid on the auction card, determining the single bid to be the winning bid and allowing the player that made the single bid to decide to keep or reject the card during a decision period and requiring the player to pay an amount of the single bid into the jackpot;

(f) if there were multiple bids, determining a highest bid to be the winning bid and allowing the player that made the highest bid to decide keep or reject the card during a decision period, and requiring the player that made the highest bid to pay an amount of the winning bid to a player having a second highest bid;

(g) calculating and limiting by the computer a liquidity that a player can use during the auction phase to an amount of the jackpot plus the amount that the player received for having the second highest bid when that player has made the second highest bid in step (f);

wherein steps (a), (b), (c), (d), (e), (f), and (g), are performed by the computer for a plurality of auction cards.

2. The method of playing a card game of claim 1, wherein the display also displays a hand currently held by each player, a current winning bid, a player's current highest bid, and an amount each player can still spend during the auction phase.

3. The method of playing a card game of claim 2, wherein the bidding period comprises a range from 3 to 5 seconds.

4. The method of playing a card game of claim 1, wherein a manager sets the bidding period using an input terminal in advance of the auction phase.

5. The method of playing a card game of claim 1, wherein the auction phase is repeated for a plurality of cards.

6. The method of playing a card game of claim 5, wherein the plurality of auction cards comprise eight cards when the plurality of players is four or fewer players.

7. The method of playing a card game of claim 5, wherein the plurality of auction cards comprise ten cards when the plurality of players is six players.

8. The method of playing a card game of claim 1, wherein the first color is green.

9. The method of playing a card game of claim 1, wherein, if there were multiple bids for the auction card, the indicator of the player with the second highest bid is shown in a second color.

10. The method of playing a card game of claim 9, wherein the second color is red.

11. The method of playing a card game of claim 1, wherein the bidding period and the decision period are chosen in advance of the auction phase by a manager and stored in the computer which performs the game.

12. The method of playing a card game of claim 1, further comprising eliminating by the computer a plurality of cards that are neither dealt nor auctioned.

13. The method of playing a card game of claim 1, further comprising the step of substituting the auction card by the player who makes the winning bid for a card held by the player who makes the winning bid.

14. The method of playing a card game of claim 1, wherein the indicator is visible to the other players.

15. The method of playing a card game of claim 1, comprising a step of performing a final phase and limiting a bet to a maximum of 1.5 times the jackpot in the final phase.

16. The method of playing a card game of claim 1, wherein the keypad or the touchpad comprises at least one bid button having a predetermined bid value.

17. A method of managing a card game by a computer; the card game comprising a plurality of players competing for a jackpot contributed by the plurality of players and a plurality of cards dealt from a simulated full deck of cards to the plurality of players, each player having access to a respective display and a respective keypad, the method comprising the steps of:

performing an auction phase by the computer, the auction phase comprising the steps of (a) revealing a face value of an auction card on the respective display to each player;

(b) auctioning the auction card in a bidding period that is timed by the computer; and (c) (i) eliminating the auction card when none of the players makes a bid for the auction card, (ii) receiving by the computer from at least one player a bid on the auction card entered by the at least one player using the respective keypad, (iii) awarding the auction card to a player who makes a sole bid and requiring the player to pay an amount of the sole bid into the jackpot, or (iv) awarding the auction card to a player who makes a winning bid among a plurality of bids and requiring the player to pay an amount of the winning bid to a player having a second highest bid;

(d) calculating and limiting by the computer a liquidity that a player can use during the auction phase to an amount of the jackpot plus the amount that the player received for having the second highest bid when that player has made the second highest bid in step (c)(iv);

wherein steps (a), (b), (c), and (d), are performed by the computer for a plurality of auction cards;

wherein the plurality of auction cards is less cards than a difference between the plurality of cards dealt to the plurality of players and a number of cards in the full deck of cards.

* * * * *